United States Patent [19]

Gregor et al.

[11] 4,189,272

[45] Feb. 19, 1980

[54] METHOD OF AND APPARATUS FOR CHARGING COAL INTO A COKE OVEN CHAMBER

[75] Inventors: Karl Gregor, Bochum; Kurt Asmus, Erfstadt, both of Fed. Rep. of Germany

[73] Assignee: Gewerkschaft Schalker Eisenhutte, Gelsenkirchen-Schalke, Fed. Rep. of Germany

[21] Appl. No.: 881,609

[22] Filed: Feb. 27, 1978

[51] Int. Cl.[2] ..... C10B 31/04

[52] U.S. Cl. ..... 414/161; 202/262; 414/163; 414/199; 414/786

[58] Field of Search ..... 214/18 PH, 35 R, 18.2, 214/17 CA, 152; 414/161, 163, 786, 199; 193/30; 201/24; 202/262, 263

[56] References Cited

U.S. PATENT DOCUMENTS

| | | | |
|---|---|---|---|
| 1,098,374 | 6/1914 | Feicks | 214/18 PH X |
| 1,785,750 | 12/1930 | Van Ackeren | 202/263 |
| 2,791,320 | 2/1974 | Gidick | 214/35 R X |

FOREIGN PATENT DOCUMENTS

| | | |
|---|---|---|
| 541754 | 1/1932 | Fed. Rep. of Germany. |
| 7233752 | 9/1972 | Fed. Rep. of Germany. |
| 2331077 | 1/1974 | Fed. Rep. of Germany. |
| 7403307 | 1/1974 | Fed. Rep. of Germany. |
| 2425538 | 2/1975 | Fed. Rep. of Germany. |
| 2343043 | 3/1975 | Fed. Rep. of Germany. |
| 494225 | 10/1933 | United Kingdom. |
| 502928 | 3/1939 | United Kingdom. |

*Primary Examiner*—Robert G. Sheridan
*Attorney, Agent, or Firm*—Karl F. Ross

[57] ABSTRACT

Coke is charged into a coke oven chamber by positioning a filling hopper over an opening in the roof of the chamber and evacuating the chamber. A filling tube is lowered from the hopper to the bottom of the chamber and coal is fed from the hopper through the filling tube into the chamber while gas is evacuated from the latter during the filling. The filling tube is raised as the chamber is filled with coal through the tube and the velocity with which the tube is raised is controlled as a function of the subatmospheric pressure generated in the chamber by the evacuation of gas therefrom. Alternatively, the subatmospheric pressure generated in the chamber is controlled as a function of the velocity with which the tube is raised.

10 Claims, 6 Drawing Figures

METHOD OF AND APPARATUS FOR CHARGING COAL INTO A COKE OVEN CHAMBER

FIELD OF THE INVENTION

The present invention relates to a method of and to an apparatus for the charging of a coke oven chamber with coal and, more particularly, to a process and apparatus for the charging of coal, especially predried and/or preheated coal and/or coal having a high proportion of volatile components, into the chambers of a coke oven battery.

BACKGROUND OF THE INVENTION

It is known to evacuate a coke oven chamber during the charging of coal into the same and to process the evacuated gas to recover coal dust and valuable components (byproducts) from the charging gas.

In the charging of coal into the chambers of a coke oven battery, it is common practice to provide a charging carriage upon the top or roof of the coke oven battery, this carriage being provided with a plurality of filling hoppers each of which can be aligned with an opening in the roof to charge the chambers in succession. It is also known to evacuate the resulting filling gas, which constitutes a gas-dust mixture, from the chamber during the filling process.

Especially when the charge consists of preheated coal, usually at a temperature up to about 250° C., the filling gas which is displaced by the coal entering the coking chamber, contains large amounts of coal dust which is generally referred to in the industry as carryover.

It is important, on the one hand, that the gas/dust mixture not be released directly into the atmosphere because it contains toxic and pollutant components, and, on the other hand, to recover, for economic reasons, the relatively large amounts of carryover coal dust in the gas stream.

It has been determined that the charging of preheated coal into the chambers of a coke oven battery can result in evacuation of up to 1% of the charge in the form of coal dust with the evacuated gas. If, as is commonly the case, the chamber of a coke oven battery can receive a charge of up to 40 metric tons of coal, approximately half of a ton of coal may be lost by the entrainment thereof with the evacuated gas. Not only does this constitute a loss of a valuable component, but it generally overloads the particle separators, the gas coolers and the like and can even result in the formation of deposits in the tar separator, the gas cooler and the gas lines. Such deposits can interfere markedly with the overall effectiveness of the coking installation.

It has been proposed to overcome this problem, as much as possible, by preventing the charge from mixing with the evacuated filling gas. To this end, German patent DT-PS No. 541 754 discloses a system which eliminates the free fall of the coal into the chambers of the coke oven battery by introducing the coal with the aid of telescopically raisable and lowerable filling tubes so that the incoming coal is deposited as close as possible upon the bottom of the chamber or on the previously introduced coal.

In spite of such precautions, however, it is found in practice that portions of the filling gas are released into the atmosphere in an untreated manner to the detriment of the environment and that some significant quantities of coal dust are entrained with the gas which is released into the atmosphere.

OBJECTS OF THE INVENTION

It is an object of the present invention to provide a process for the charging of coal into the chambers of a coke oven battery so that an uncontrolled release of the filling gas does not occur.

It is another object of this invention to provide a method of operating a coal-charging apparatus for a coke oven which, in a simple manner, ensures that large amounts of coal dust will not be lost in the filling gas.

Still another object of this invention is to provide a process for the filling of a chamber of a coke oven battery which affords simple control of the introduction of the coal and yet limits sharply the amount of coal dust which may be carried away by the filling gas.

Another object of this invention is to provide an improved charging apparatus for a coke oven chamber.

It is also an object of this invention to provide a method of and an apparatus for the charging of coal into the coking chamber of a coke oven battery whereby the disadvantages of earlier systems are avoided.

SUMMARY OF THE INVENTION

The invention which is capable of attaining all of the aforedescribed objects comprises a process for the charging of coal, especially predried and/or preheated coal and/or coal containing a high proportion of volatile components, into a coking chamber of a coke oven which comprises positioning a filling hopper over an opening in the roof of the chamber and sealingly connecting this opening to the hopper, lowering a filling tube from the hopper substantially to the bottom of the chamber, feeding coal from the hopper through the filling tube into the chamber and simultaneously evacuating gas from the chamber during the filling thereof with coal through the tube, raising the filling tube in the chamber as the chamber is filled with coal through the tube, and controlling the velocity with which the tube is raised as a function of the subatmospheric pressure generated in the chamber by the evacuation of gas therefrom or controlling the subatmospheric pressure generated in the chamber by the evacuation of gas therefrom as a function of the velocity with which the tube is raised.

Thus, according to the invention, either the lifting velocity of the filling tube in the chamber is controlled in dependence upon the level of the subatmospheric pressure generated in the chamber or the level of this subatmospheric pressure is controlled using as the input variable for its control system, the lifting velocity of the filling tube, since as it is a main disclosure of the invention, up to a limiting value the coal charging velocity is dependent on the velocity with which the filling tube is raised from the bottom of the chamber.

Surprisingly, this control arrangement in which the velocity with which the filling tube is raised is related to the level of subatmospheric pressure maintained in the chamber during the continuous charging of coal into the latter and the continuous evacuation thereof along with the continuous lifting of the tube, prevents an uncontrolled release of the filling gas from the chamber in a relatively simple manner, and in addition, markedly reduces the quantity of coal dust entrained with the gas, even by comparison with the aforedescribed earlier system which also utilizes a filling tube.

Either the subatmospheric pressure generated in the chamber is used to control the velocity with which the filling tube rises or the level of the subatmospheric pressure is controlled in response to the rise velocity of the filling tube. In both cases relatively simple means ensures that the subatmospheric pressure will preclude an uncontrolled release of the filling gas into the atmosphere and a minimum entrainment of coal dust with the filling gas which is evacuated.

According to another aspect of the invention, the filling process is carried out with a charging carriage displaceable across the top or roof of the coke oven battery and provided with a plurality of hoppers alignable with respective openings of a common chamber of the coke oven battery. According to the invention, each of the filling hoppers is provided with a raisable and lowerable, preferably telescoping, filling tube which reaches downwardly through the respective opening substantially to the bottom of the chamber, means being provided to lift the filling tube to conform to the rate of addition of the coal so that the lower end of the filling tube is either directly above the upper level of the coal within the chamber or lies somewhat below the upper surface of the charge in the chamber.

According to the principles of the present invention, within the hopper, i.e. within each hopper, there is provided a respective closure member which blocks selectively the discharge end of the hopper and is hollow to receive the filling tube when it is withdrawn into its upper position. This body may be vertically elongated and upright so as to form a casing within which the telescopingly compacted filling tube is received.

Thus, when a filling tube is not required for the charging of coal into the chamber through an appropriate opening, it can be withdrawn fully into the hopper without interference with the supply of charge contained therein, thereby enabling displacement of the carriage to another row of openings and another chamber without interference between the filling tube and the roof of the coke oven.

In a preferred embodiment of the apparatus aspect of the invention, each of the filling hoppers is provided with a telescopingly extendable sealing member adapted to seal against the edge of the filling opening in the roof of the coke oven battery. This permits the opening to be sealed with respect to the hopper so that the gas/dust mixture cannot escape and, indeed, can be evacuated.

To further prevent any detrimental release or effect of the gas/stroke mixture, it has been found to be advantageous not only to seal the lower end of the hopper with respect to the charging opening in the roof of the coke oven, but also to seal the upper or inlet end through which the coal is introduced into the hopper and to provide above the charge of coal in each hopper, an inert gas, e.g. nitrogen, cushion. This prevents the filling gas and any dust which may be entrained thereby from passing upwardly through the filling tube and then being emitted from the filling hopper at the upper or inlet end thereof into the atmosphere. The inert gas cushion also precludes the formation of any gas/dust mixture above the coal in the hopper which has reached the explosive limit.

According to another preferred embodiment of the invention, the inlet opening of the filling funnel is provided with a sand-filled rim which can be engaged by a telescoping fitting through which the coal is charged into the hopper. This telescoping fitting, in the form of a connecting pipe, can penetrate into the sand and thereby form a seal preventing the escape of coal dust and gas to the atmosphere.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
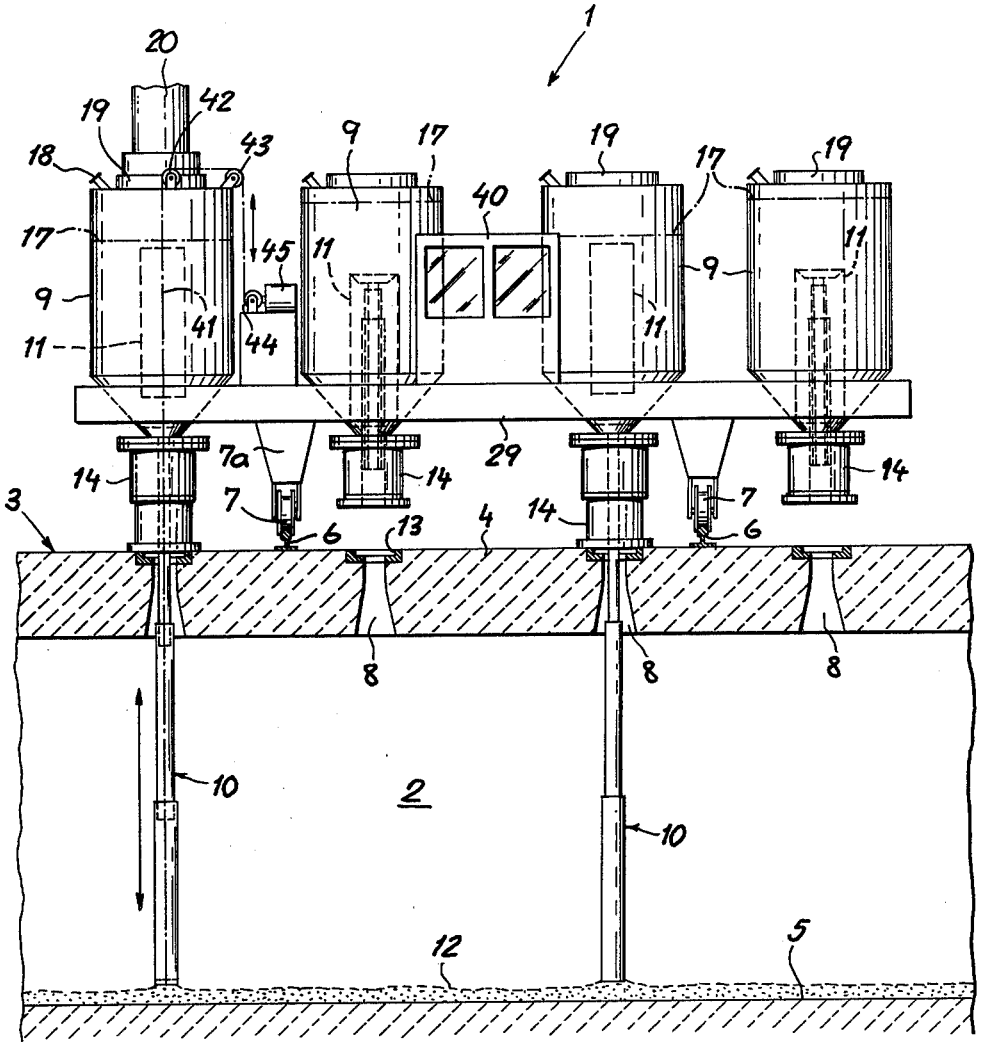
FIG. 1 is a diagrammatic vertical cross-sectional view through one chamber of a coke oven battery of conventional construction showing the charging of this chamber by a filling carriage only a portion of which has been illustrated, also in diagrammatic form.
Figure 2:
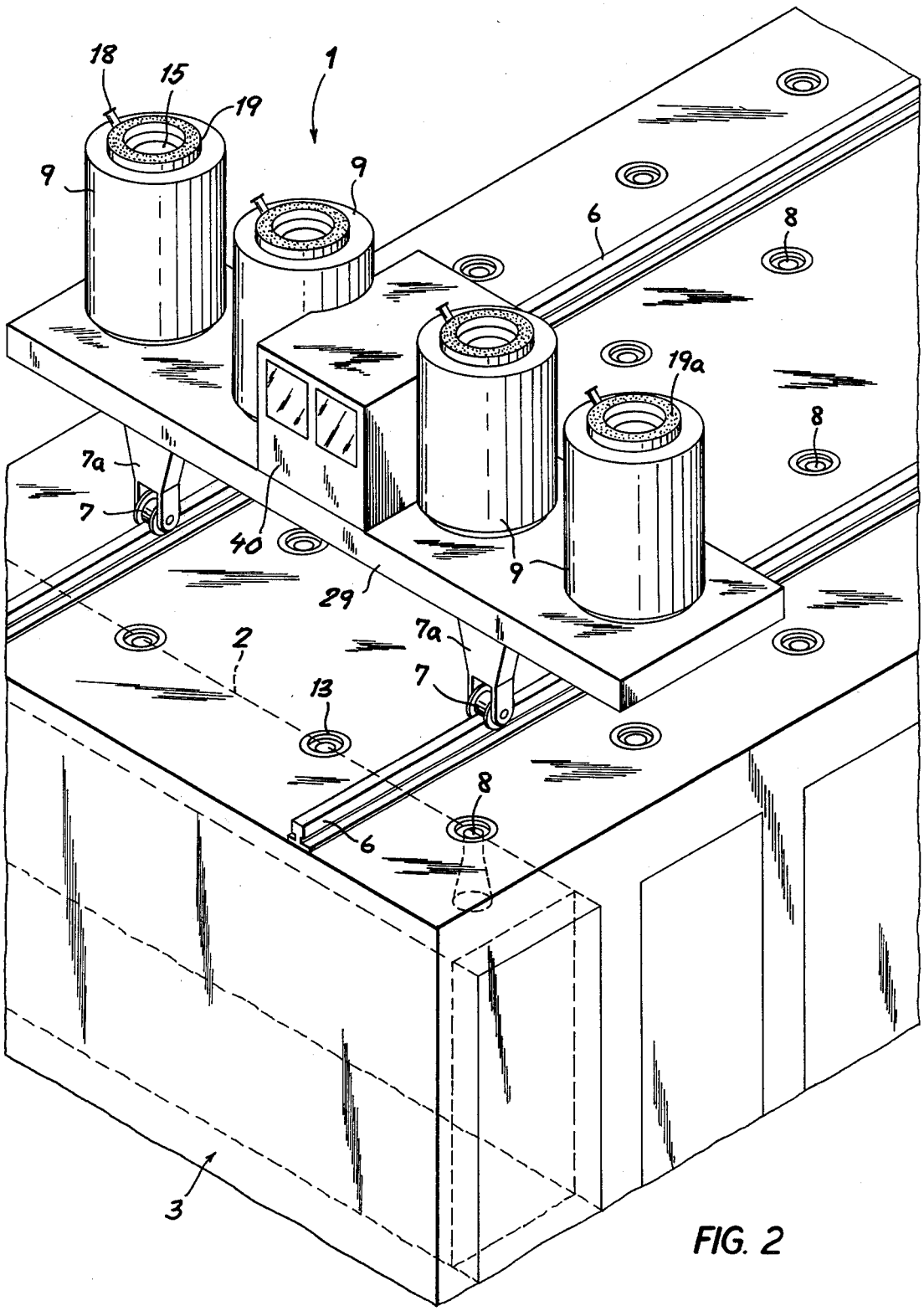
FIG. 2 is a diagrammatic partial perspective view of the carriage atop the coke oven battery.

From FIGS. 1 and 2, it will be apparent that the diagrammatically illustrated charging carriage 1 comprises a chassis 29 receiving a cabin 40 in which the operator may sit and from which the operator can control the filling process. The chassis 29 is mounted by supports 7*a* and wheels 7 upon tracks provided upon the roof of a coke oven battery 3 having a succession of chambers 2 whose filling openings 8 can be sealed by means not shown but which serve to receive the coal charge.

The roof of the chamber is represented at 4 and the floor thereof is shown at 5 and, in FIG. 1, a layer 12 of coal, previously introduced into the chamber 2, has been shown to have a level above the floor 5 designated by broken lines.

Each of the openings 8 is alignable with a respective hopper 9 of the carriage 1. The hoppers 9 each include telescopingly extendable and contractable filling tubes 10 which can be raised and lowered through the openings 8 as shown in FIG. 1 to reach substantially to the bottom or floor of the chamber. Within each hopper 9, moreover, there is provided a closure member 11 which serves to block and unblock the outlet of the filling hopper and to receive the telescopingly contracted filling tube 10 as has been illustrated for the right-hand hopper 9.

This construction allows the filling tube 10 to be lowered to the bottom of the hopper and coal to fall by gravity from each hopper into the chamber with a minimum of free fall and release of dust.

As the coal level rises in the hopper, the filling tube 10 is raised by a cable 41 which is anchored to the lower member of the filling tube and passes over idler pulleys 42 and 43 before being wound upon a windlass 44 driven by a motor 45.

In order to preclude any uncontrolled release of the filling gas from the chamber 2, the evacuation of the chamber 2 is controlled in dependence upon the lifting velocity of the filling tube or the subatmospheric pressure generated within the chamber is controlled using as the control input, the magnitude of the lifting velocity of the filling tube. This control system will be described in greater detail in connection with FIG. 6.

The top of each hopper is provided with a filling opening (see FIG. 3) which can be surrounded by a sand seal engageable by the lower end of a telescoping filling pipe 20 connected to a stationary hopper for the charging of coal into the hoppers 9 and represented diagrammatically at 20. In other words, the telescoping connecting pipe 20 can connect the hoppers 9 with the usual coal bunker (not shown).

At their lower ends, each of the hoppers 9 is provided with a telescoping sealing cylinder 14 which sealingly engages the edge 13 around a respective opening 8 to prevent escape of gas.

Each hopper is also provided with an inert-gas inlet 18 at its top so that an inert-gas cushion 17 can be provided above the level of coal therein.

Figure 3:
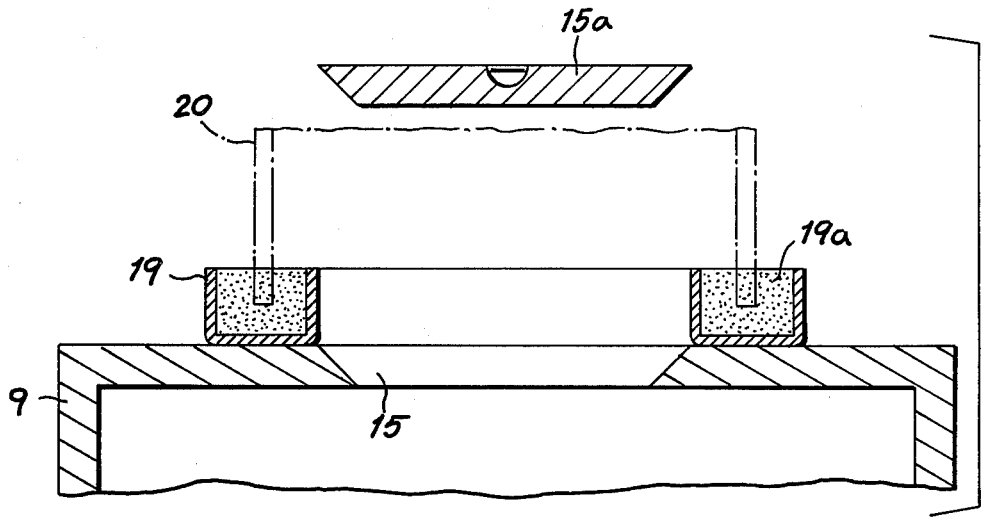
FIG. 3 is a detail view, in diagrammatic form, illustrating the inlet opening at the top of a hopper of the carriage of FIGS. 1 and 2.

Referring now to FIG. 3, it will be seen that the top of each hopper 9 is provided with an inlet opening 15 which can be sealed by a cover **15*a* and is surrounded by an upwardly open channel-shaped casing 19 forming a rim filled with sand 19*a* into which the lower end of the connecting pipe 20 may penetrate. When the connecting pipe 20 is removed, the cover 15*a*** can be applied to retain the inert-gas cushion therebelow. Inert gas can be fed continuously to the hopper during the discharge of coal therefrom so that the inert-gas cushion is maintained at atmospheric or slightly superatmospheric pressure.

The lower end of the hopper is provided with a discharge opening 16 (see FIGS. 1 and 4) which communicates with a downwardly converging frustoconical or funnel-shaped portion **9*a* which can be sealingly engaged by the lower outer edge 11*b* of the casing 11. The latter can be raised and lowered within the hopper by a cable 46 and a windlass 47** shown diagrammatically in FIG. 5.

Figure 4:
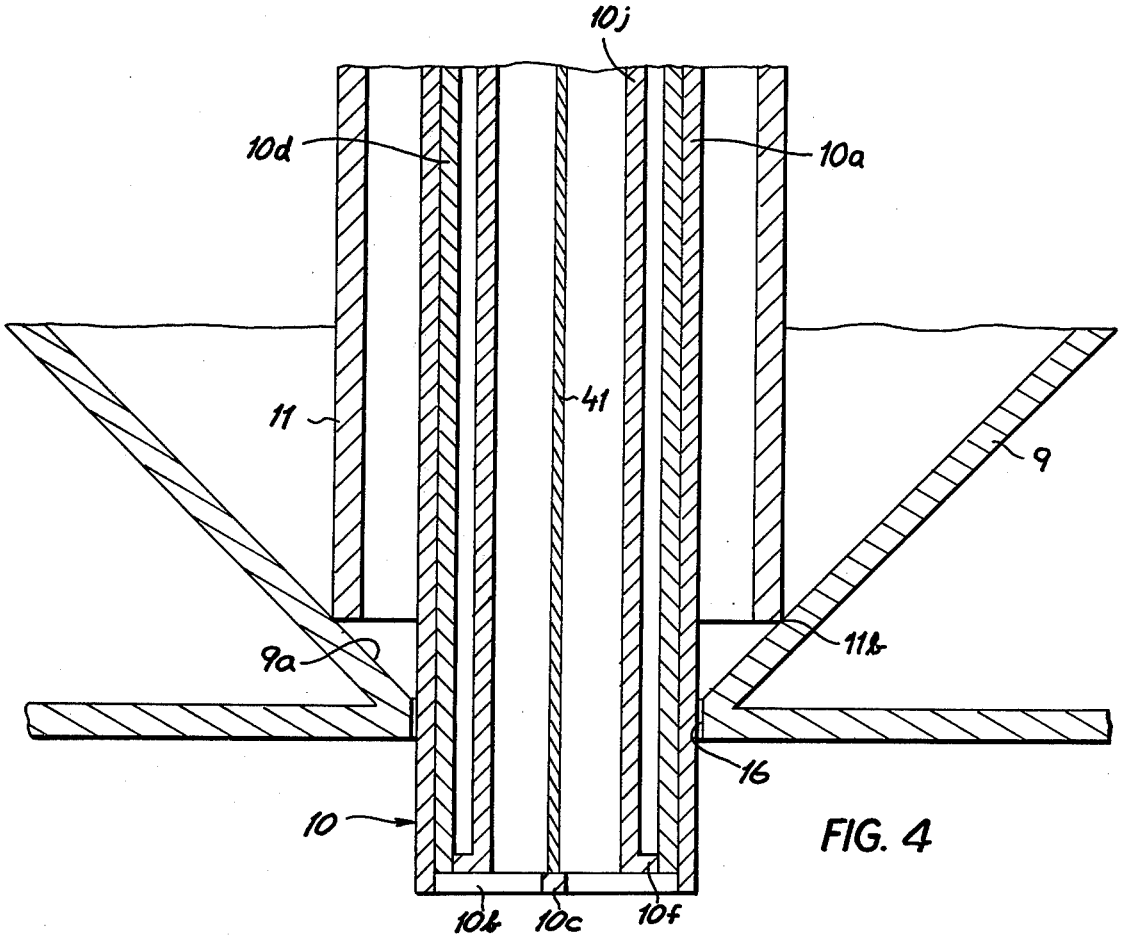
FIG. 4 is a detail cross-sectional view through a portion of the discharge end of such a hopper.

FIG. 4 also shows in somewhat greater detail the construction of the filling tube 10. The filling tube 10 has an outer or lower member **10*a* which is provided, at its bottom, with a perforated plate 10*b* to which the cable 41 is anchored. The cable 41 passes upwardly through the filling tube 10 and is displaced by the windlass 44, 45** previously described.

Figure 5:
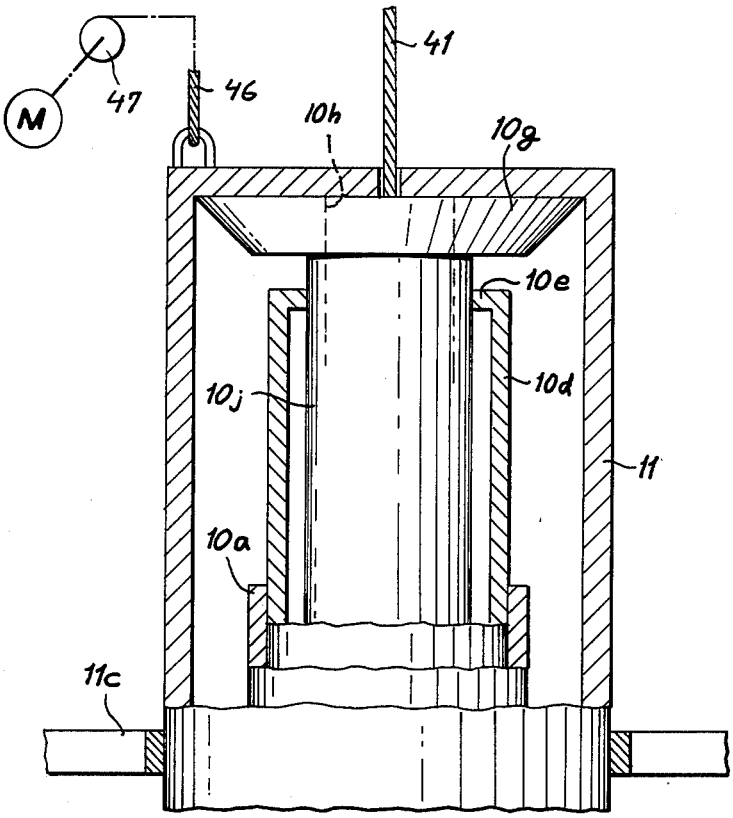
FIG. 5 is a cross-sectional view, partly in elevation and also in diagrammatic form, illustrating the upper end of the closure member which is adapted to form a casing for the filling tube.

The outer tube **10*a*, which passes through the opening 16 at the bottom of the funnel 9*a* and through the cylindrical outlet 14 of the hopper, surrounds and telescopingly fits over an intermediate tube 10*d* which is formed at its upper edge with an inwardly extending shoulder 10*e*** (see FIG. 5).

The intermediate tube **10*d* telescopingly receives the inner tube 10*j* which is provided at its lower end with an outwardly extending shoulder 10*f*. The cable 41 is anchored at 10*c* to the plate 10*b***.

Thus, as the cable 41 is lowered, all of the tubes **10*a*, 10*d* and 10*j* drop downwardly until an outwardly extending frustoconical shoulder 10*g* of the tube 10*j* engages the lowermost frustoconical portion 9*a*** of the hopper.

When the member **10*g* catches upon the portion 9*a* the inner tube 10*j* is retained against further descent. The tube members 10*a* and 10*d* continue their descent until the shoulder 10*e* engages the shoulder 10*f* of the inner tube 10*j*. Thereafter, the outer tube 10*a*** continues its descent until it reaches the bottom of the chamber.

Upon elevation of the cable 41, the outer tube **10*a* first rises until the lower end or plate 10*b* engages the lower end of tube 10*d* whereupon this small intermediate tube is raised. The plate 10*b* then engages the bottom of tube 10*j* to lift this inner tube and the telescopingly compacted tubes are thereupon raised into the casing 11. The casing 11 is guided in the hopper by means represented diagrammatically at 11*c*** in FIG. 5. Such means may include vanes reaching from the cylindrical walls of the hopper.

Figure 6:
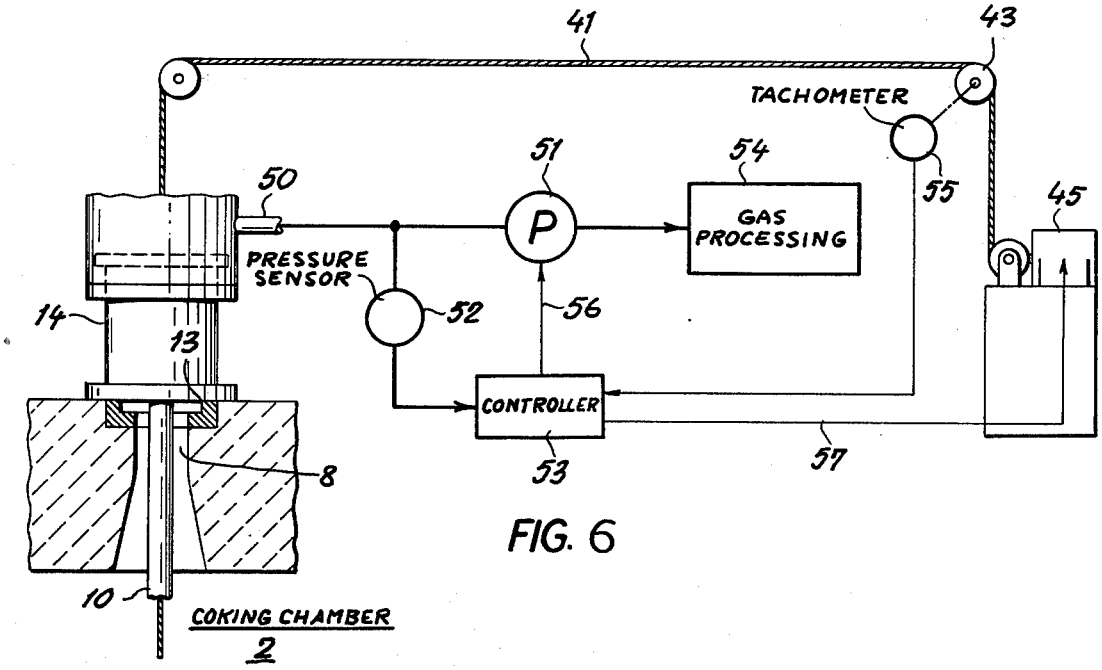
FIG. 6 is a diagram illustrating principles of the present invention.

As can be seen from FIG. 6, when the member 14 sealingly engages the rim 13 surrounding the opening 8 of the chamber 2, the opening is hermetically sealed with respect to the hopper and the chamber 2 can be evacuated through a fitting 50 provided on the hopper and communicating with the opening 8 around the filling tube 10. Evacuation can be effected by a pump 51 and the subatmospheric pressure in the coking chamber is detected by a pressure sensor 52 providing an input to a controller 53. The gas withdrawn by the pump 51 can be supplied to a processor 54 in which particulates are separated from the gas, the gas is cooled, tar is removed and any other desired scrubbing or cleaning operation can be carried out before the gas is released into the atmosphere.

One of the pulleys 43 is provided with a tachometer 55 which has an output representing the velocity with which the filling tube 10 is raised by the cable 41. The tachometer 55 also provides an input to the controller 53. One output of the controller 53 is applied at 56 to the pump 51 while another output is applied at 57 to the windlass motor 45.

Thus the controller can regulate either the pumping rate 51 in response to the output from the tachometer 55 or the winch motor 45 in response to the level of the pressure in chamber 2 (subatmospheric pressure) generated by the pump 51.

We claim:

1. A process for the charging of coal, especially predried and/or preheated coal and/or coal containing a high portion of volatile components into a coking chamber of a coke oven, said process comprising the steps of:

positioning a filling hopper over an opening in the roof of said chamber and sealingly connecting said opening to said hopper;

lowering a filling tube from said hopper substantially to the bottom of said chamber;

feeding coal from said hopper through said filling tube into said chamber and simultaneously evacuating gas from said chamber during the filling thereof with coal through said tube;

raising said filling tube in said chamber continuously as said chamber is filled with coal through said tube; and controlling the velocity with which said tube is raised as a function of the subatmospheric pressure generated in said chamber by the evacuation of gas therefrom.

2. A process for the charging of coal, especially predried and/or preheated coal and/or coal containing a high portion of volatile components into a coking chamber of a coke oven, said process comprising the steps of:

positioning a filling hopper over an opening in the roof of said chamber and sealingly connecting said opening to said hopper;

lowering a filling tube from said hopper substantially to the bottom of said chamber;

feeding coal from said hopper through said filling tube into said chamber and simultaneously evacuating gas from said chamber during the filling thereof with coal through said tube;

raising said filling tube in said chamber continuously as said chamber is filled with coal through said tube; and controlling the subatmospheric pressure generated in said chamber by the evacuation of gas therefrom as a function of the velocity with which said tube is raised.

3. A charging apparatus for a coke oven having at least one coking chamber provided with a roof having a plurality of filling openings, said apparatus comprising:

a charging carriage displaceable across said roof and provided with a plurality of hoppers each having an outlet alignable with a respective one of said openings;

means for sealing each of said hoppers to the respective openings;

a respective telescoping filling tube received in each of said hoppers and lowerable substantially to the floor of said chamber through the respective outlet and opening;

means for raising and lowering each of said tubes;

a respective hollow body received in each of said hoppers and shiftable therein to close the respective outlet, said body being positioned and constructed to receive the respective filling tube in a compact state thereof upon withdrawal of the respective filling tube from said chamber; and means for evacuating said chamber and control means responsive to the level of evacuation of said chamber for controlling the velocity with which the respective filling tube is raised.

4. The apparatus defined in claim 2 wherein said sealing means includes a telescoping cylinder assembly lowerable into engagement with a rim of the respective opening on said roof.

5. The apparatus defined in claim 3 wherein each of said hoppers is formed at the top thereof with a sealable inlet and a sand-filled rim resting on each hopper and surrounding the respective inlet.

6. The apparatus defined in claim 3 wherein each hopper has a sealable inlet adapted to receive a charge of coal and means for sealing said outlet, each hopper being provided with means for introducing an inert-gas cushion above the coal of the respective hopper.

7. A charging apparatus for a coke oven having at least one coking chamber provided with a roof having a plurality of filling openings, said apparatus comprising:

a charging carriage displaceable across said roof and provided with a plurality of hoppers each having an outlet alignable with a respective one of said openings;

means for sealing each of said hoppers to the respective openings;

a respective telescoping filling tube received in each of said hoppers and lowerable substantially to the floor of said chamber through the respective outlet and opening:

means for raising and lowering each of said tubes;

a respective hollow body received in each of said hoppers and shiftable therein to close the respective outlet, said body being positioned and constructed to receive the respective filling tube in a compact state thereof upon withdrawal of the respective filling tube from said chamber; and means for evacuating said chamber and control means responsive to the velocity with which the respective filling tube is raised for controlling said means for evacuating said chamber.

8. The apparatus defined in claim 7 wherein said sealing means includes a telescoping cylinder assembly lowerable into engagement with a rim of the respective opening on said roof.

9. The apparatus defined in claim 7 wherein each hopper is formed at the top thereof with a sealable inlet and a sand-filled rim resting on each hopper and surrounding the respective inlet.

10. The apparatus defined in claim 7 wherein each hopper has a sealable inlet adapted to receive a charge of coal and means for sealing said outlet, each hopper being provided with means for introducing an inert-gas cushion above the coal of the respective hopper.

* * * * *